US006106414A

United States Patent [19]

Yeh

[11] Patent Number: 6,106,414

[45] Date of Patent: Aug. 22, 2000

[54] THREE-LAYERED SOLID GOLF BALL STRUCTURE

[76] Inventor: Chien-Hwa Yeh, No. 54, Chiu-Chu Rd., Ta-Shu Hsiang, Kaohsiung Hsien, Taiwan

[21] Appl. No.: 09/245,070

[22] Filed: Feb. 5, 1999

[51] Int. Cl.[7] ..... A63B 37/04; A63B 37/06

[52] U.S. Cl. ..... 473/373; 473/342; 473/345; 473/350; 473/354; 473/365; 473/371; 473/372; 473/373; 473/374; 473/375

[58] Field of Search ..... 473/371, 372, 473/373, 342, 345, 350, 354, 365, 374, 375

[56] References Cited

U.S. PATENT DOCUMENTS

| | | | |
|---|---|---|---|
| 1,568,514 | 1/1926 | Lewis . | |
| 3,031,194 | 4/1962 | Strayer . | |
| 4,863,167 | 9/1989 | Matsuki et al. | 273/62 |
| 5,683,312 | 11/1997 | Boehm et al. | 473/354 |
| 5,708,131 | 1/1998 | Morgan | 528/481 |
| 5,733,206 | 3/1998 | Nesbitt | 473/377 |
| 5,779,561 | 7/1998 | Sullivan et al. | 473/373 |
| 5,896,642 | 4/1999 | Peker | 29/522.1 |
| 5,976,443 | 11/1999 | Nesbitt | 264/250 |
| 5,997,416 | 12/1999 | Maruko | 473/371 |
| 6,001,032 | 12/1999 | Onuki | 473/342 |
| 6,001,930 | 12/1999 | Rajagopalan | 525/92 B |

*Primary Examiner*—Stephen F. Gerrity
*Assistant Examiner*—Paul Kim
*Attorney, Agent, or Firm*—Rosenberg, Klein & Lee

[57] ABSTRACT

A three-layered solid golf ball structure includes a core, an intermediate layer, and an outer shell. The intermediate layer is formed from a material compounded from a thermosetting elastomer and an amorphous alloy so as to attribute high strength and high elasticity to the golf ball. The specific weight and hardness of the golf ball can also be adjusted to achieve preferred sense of striking, a farther flying distance, and a longer useful life.

1 Claim, 2 Drawing Sheets

THREE-LAYERED SOLID GOLF BALL STRUCTURE

BACKGROUND OF THE INVENTION (a) Field of the Invention

The present invention relates to a three-layered solid golf ball structure.

(b) Description of the Prior Art

In playing golf, good golf equipment is as important as good golf skill. For solid three-layered golf balls, their quality is determined by three factors. The first is a preferred sense of striking, i.e., it permits the player to control the direction of the striking of the ball. The second is the rate of self-spinning of the ball, which, when all external conditions are matched, allows the ball to fly through a farther distance and to land on the ground without much bouncing. The third is the strength of the ball. The greater the strength of the ball, the longer its usable life. FIG. 1 shows a conventional solid three-layered golf ball 1. It essentially comprises a core 11, an intermediate layer 12, and an outer shell 13. The core 11 is made of an elastic material compounded mainly from a high elastic polymer and various high performance additives. The intermediate layer 12 is comprised of a multiplicity of rubber threads repeatedly wound on the circumference of the core 11. The outer shell 13 is made of an ionomer resin. Compared to a two-layered golf ball, the three-layered golf ball 1 as such has a preferred sense of striking to permit better ball controllability. However, as it has a high rate of self-spinning, although it can land on the ground in a preferred manner, the flying distance is not good. And besides, since the intermediate layer is comprised of rubber threads, the strength of the golf ball is low. Under a forceful striking, the rubber threads may disengage from the surface of the core 11. In other words, the intermediate layer 12 will become detached, and the durability of the golf ball is comparatively poor. Moreover, a strange sound will emit the instant the ball is hit. FIG. 2 shows another type of a three-layered golf ball 2. The golf ball 2 includes a core 21, an intermediate layer 22, and an outer shell 23. The core 21 is made of an elastic material compounded using a high elastic polymer as a major material and various high performance additives. The intermediate layer 22 is made of a thermoplastic elastomer material. The outer shell 23 is likewise made of an ionomer resin. In this three-layered golf ball 2, since the intermediate layer 22 is made of a thermoplastic elastomer, it has preferred strength, enhanced sense of striking, and farther flying distance, as compared with the golf ball 1 described above. However, the intermediate layer 22 does not have the softness of the rubber threads. Therefore, although the flying distance is better, the landing of the golf ball is not as good. Hence, improvements on the prior art are desirable.

SUMMARY OF THE INVENTION

The present invention relates to a three-layered solid golf ball structure.

A primary object of the present invention is to provide a three-layered solid golf ball structure, in which an intermediate layer of the golf ball is formed from a thermosetting elastomer and an amorphous alloy so as to enhance the strength and durability of the golf ball. And besides, loss of energy during transmission can be reduced to achieve a farther flying distance.

Another object of the present invention is to provide a three-layered solid golf ball structure, in which an intermediate layer of the golf ball is formed from a thermosetting elastomer and an amorphous alloy, the content of the amorphous alloy being adjustable as required to change the specific weight of the golf ball to thereby adjust the self-spinning rate of the golf ball to meet the player's needs.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
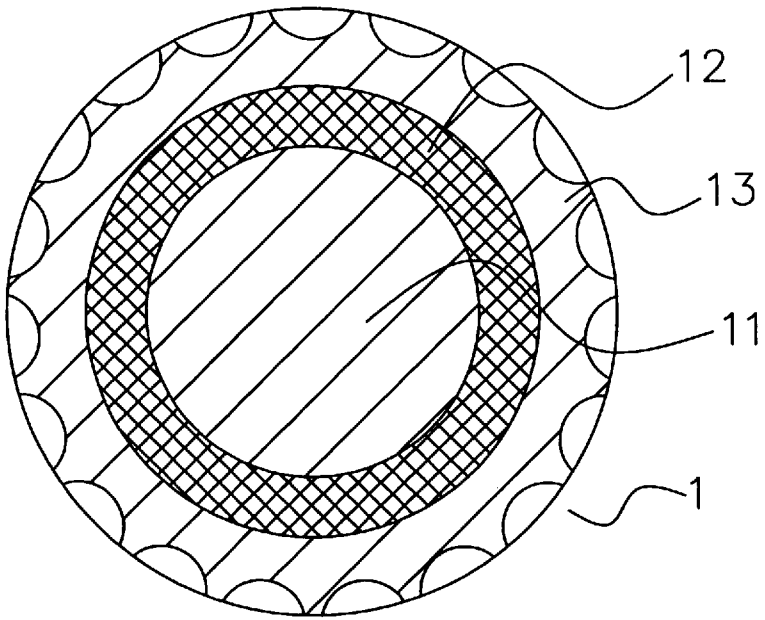
PRIOR ART FIG. 1
FIG. 1 is a cross sectional view illustrating the structure of a conventional type of three-layered golf ball.
Figure 2:
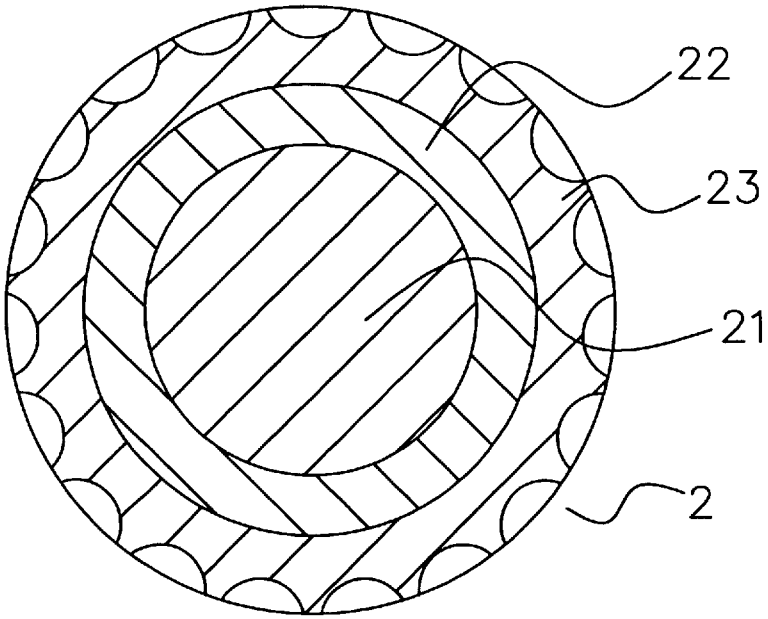
PRIOR ART FIG. 2
FIG. 2 is a cross sectional view illustrating the structure of another conventional type of three-layered golf ball.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
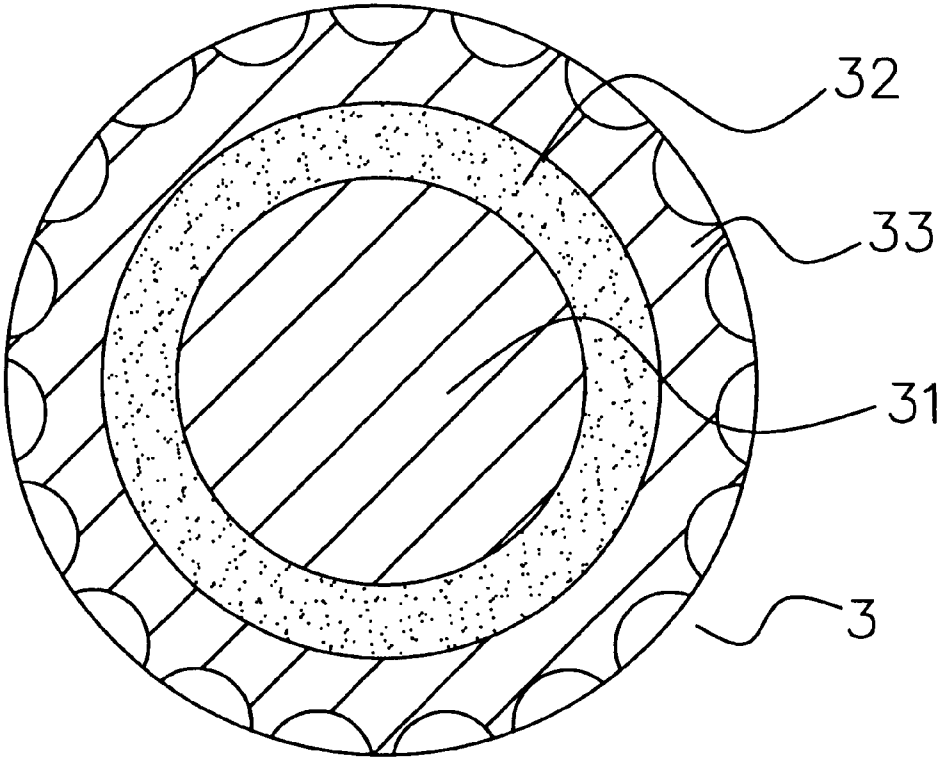
FIG. 3 is a cross sectional view showing a preferred embodiment of the golf ball of the present invention.

With reference to FIG. 3, a golf ball 3 of the present invention is shown to comprise, like the prior art, a core 31, an intermediate layer 32, and an outer shell 33. The core 31 is formed from an elastic material compounded chiefly from a thermosetting material and a plurality of high performance additives. The intermediate layer 32 is made of a material compounded from a thermosetting elastomer and an amorphous alloy. The outer shell 33 is, like the prior art, formed from an ionomer resin. It can be seen that the present invention differs from conventional three-layered golf balls in that the intermediate layer 32 is formed using different materials.

As the material synthesized from thermosetting elastomer and amorphous alloy has high strength and high elasticity as well as high metal contents, the intermediate layer 32 has the characteristics of high strength and high elasticity, and hence enhanced durability. Moreover, due to the high strength and high elasticity of the intermediate layer, the molecules of the intermediate layer 32 are more densely packed so that when the golf ball 3 is depressed at the instant it is hit by the club, it can quickly resume its shape so that loss of energy during transmission after striking is reduced to a minimum. Hence, the golf ball 3 can travel a farther distance. In addition, the metal contents, i.e., the contents of the amorphous alloy, may be changed at will. The quantity of the metal contents can be used to adjust the specific weight of the golf ball 3 so that golf balls of different specific weights can be manufactured. As the specific weight of a golf ball is critical to the self-spinning rate of the ball, by giving the golf ball different specific weights, different self-spinning rates can be achieved. As the self-spinning rate of the golf ball affects the flying distance and landing of the golf ball, the structure of the intermediate layer 32 according to the present invention enables the player to select golf balls having desired self-spinning rates to match different playing environments so as to achieve optimum striking effects. In sum, the golf ball 3 of the present invention not only eliminates the drawbacks of conventional three-layered golf balls, it can also maintain preferred sense of striking and good ball controllability.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A three-layered solid golf ball structure, comprising a core, an intermediate layer, and an outer shell, the core being formed from a material compounded from a thermosetting material, the outer shell being formed from an ionomer resin, and the intermediate layer formed from a material compounded from a thermosetting elastomer combined with an amorphous alloy.

* * * * *